United States Patent [19]

Van Weelden

[11] Patent Number: 4,868,935

[45] Date of Patent: Sep. 26, 1989

[54] MOVABLE GLIDE SUPPORT FOR TUB ENCLOSURE AND SHOWER STALL DOORS

[75] Inventor: Roger M. Van Weelden, Chicago, Ill.

[73] Assignee: Sterling Plumbing Group, Inc., Del.

[21] Appl. No.: 720,515

[22] Filed: Apr. 5, 1985

[51] Int. Cl.[4] ..... A47K 3/22

[52] U.S. Cl. ..... 4/610; 4/607; 49/411; 16/87 R; 16/87.6 R

[58] Field of Search ..... 4/610, 607, 608; 49/409–411; 16/87 R, 87.2, 87.4 R, 87.6 R, 87.8 R, 93 R, 94 R, 99, 105, 96 R; 308/3 R; 160/196 R, 196 D, 330, 124, 126, 345, 346

[56] References Cited

U.S. PATENT DOCUMENTS

| | | | |
|---|---|---|---|
| 299,156 | 5/1884 | Moore | 16/105 |
| 1,152,630 | 9/1915 | Hoffman | 16/94 R |
| 1,615,856 | 2/1927 | Vallen | 160/126 |
| 2,117,606 | 5/1938 | French | 16/87.8 |
| 2,791,006 | 5/1957 | Eichler | 49/411 |
| 3,198,243 | 8/1965 | Ford | 160/345 |
| 3,457,677 | 7/1969 | Ziegler | 49/409 |
| 3,473,266 | 10/1969 | Miller | 16/87 R |
| 3,522,621 | 8/1970 | Ford et al. | 160/345 |
| 3,615,144 | 10/1971 | Plemeng | 49/411 |
| 4,051,633 | 10/1977 | Voegele, Jr. | 49/411 |

FOREIGN PATENT DOCUMENTS

| | | | |
|---|---|---|---|
| 677181 | 12/1963 | Canada | 16/87.4 R |
| 733802 | 5/1966 | Canada | 16/87.4 R |
| 2809404 | 6/1979 | Fed. Rep. of Germany | 4/607 |
| 1296145 | 5/1962 | France | 49/410 |
| 2254222 | 4/1975 | France | 49/409 |
| 1131924 | 10/1968 | United Kingdom | 49/409 |

*Primary Examiner*—Linda J. Sholl

[57] ABSTRACT

A structure comprising by-pass doors for use in tub enclosures or shower stalls, each door having a frame and a panel mounted in the frame, and a hanger assembly integral therewith provided with glides adapted to move on a track provided on a supporting door frame or header, the track having plastic bearing members for slideably supporting the glides.

8 Claims, 3 Drawing Sheets

MOVABLE GLIDE SUPPORT FOR TUB ENCLOSURE AND SHOWER STALL DOORS

BACKGROUND OF THE INVENTION

1. Field of the Invention

The present invention relates to structures for mounting a slidable door rails for movement thereon, and more particularly refers to a door support structure utilizing glides slidably mounted on rails.

2. Description of the Prior Art

Movable door assemblies are generally formed of one or more doors each comprising a frame in which a panel of plastic material or glass is mounted. The doors have hangers affixed at the top of each door provided generally with rollers mounted on the hangers, the rollers being supported on a track which is fixedly mounted. However, glides moving along tracks have generally not been used for this purpose, and when they have been used, they have not always been sufficiently free of friction. Moreover, there has been a tendency for the glides to become derailed during extended use.

SUMMARY OF THE INVENTION

It is an object of the present invention to provide a glide and rail type of structure for movably supporting door panel assemblies.

It is a further object to provide a structure utilizing glides supported by rails which have low friction and wherein the glides are positively retained on the tracks or rails.

It is still further an object to provide a glide structure which may be supported by an adjustable hanger adapted to compensate for out-of-plumb walls and supporting structures.

These and other objects, advantages and functions of the invention will be apparent on reference to the specification and to the attached drawings illustrating preferred embodiments of the invention, in which like parts are identified by like reference symbols in each of the views.

DESCRIPTION OF THE PREFERRED EMBODIMENTS

Figure 1:
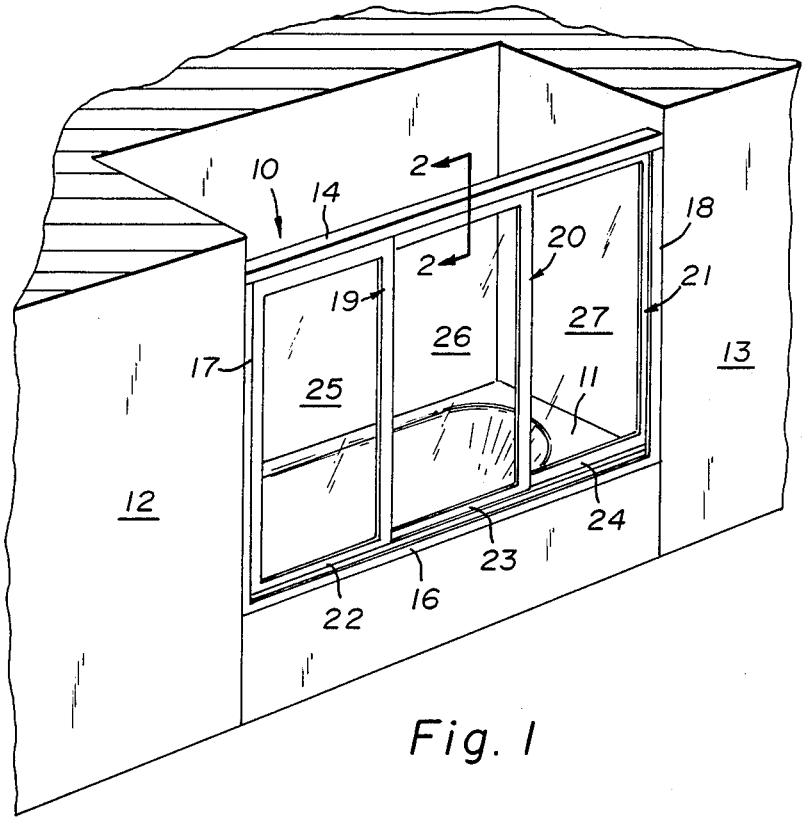
FIG. 1 is a perspective view of a tub enclosure provided with bypass doors according to the invention.

Referring to the drawings and particularly FIG. 1, a tub enclosure 10 is shown mounted on a bathtub 11 between bathroom walls 12 and 13. A long front header or supporting member 14 is mounted between the walls. A sill track 16 is mounted on the tub 11. End jambs 17 and 18 are mounted on the walls 12 and 13. Doors 19, 20 and 21 are mounted within the enclosure, having door frames 22, 23, and 24, and panels 25, 26 and 27, as for example glass panels, respectively.

Figure 2:
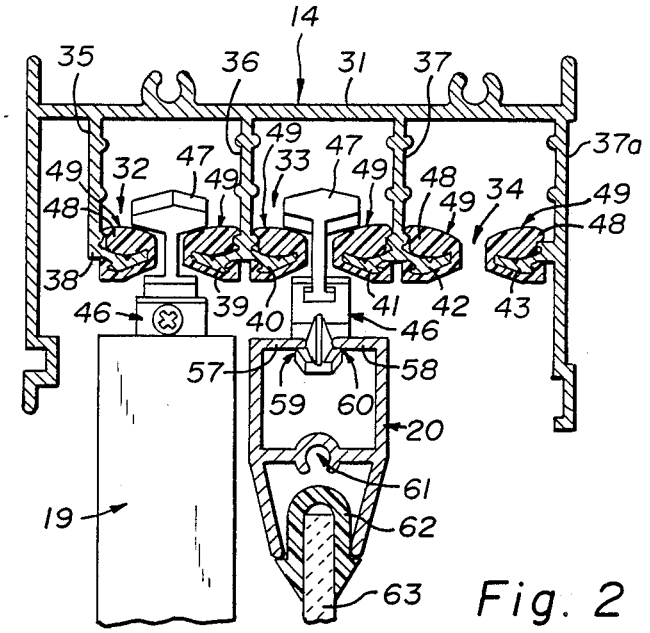
FIG. 2 is a cross-sectional view of a portion of the structure shown in FIG. 1, taken at the line 2—2 of FIG. 1, looking in the direction of the arrows.
Figure 3:
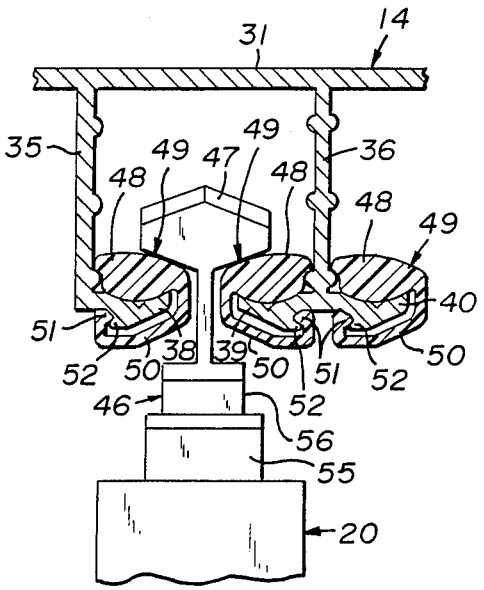
FIG. 3 is a cross-sectional view of an enlarged portion of the structure shown in FIG. 2.
Figure 5:
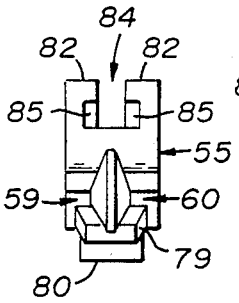
FIG. 5 is a rear view of the structure shown in FIG. 4.
Figure 4:
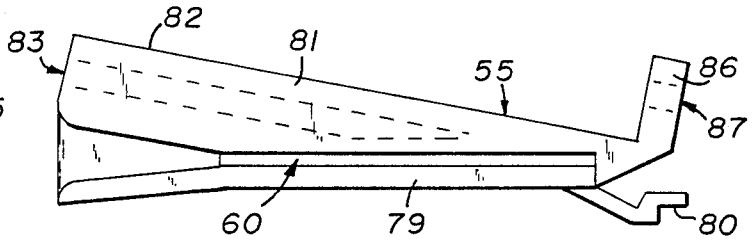
FIG. 4 is a side elevational view of a lower adjustment member.
Figure 7:
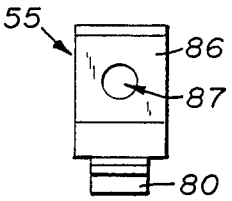
FIG. 7 is a front view of the structure shown in FIG. 6.
Figure 6:
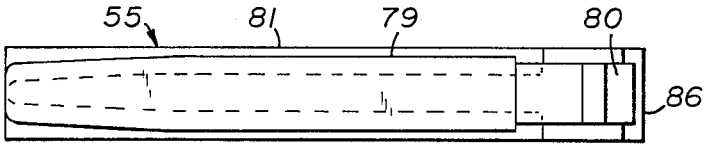
FIG. 6 is a bottom view of the structure shown in FIGS. 4 and 5.

Referring to FIGS. 2 and 3, the header 14 is shown in cross-section and comprises a top web 31 having track spaces 32, 33 and 34 defined by supporting webs 35, 36, 37 and **37*a* and having transverse track flanges or legs 38, 39, 40, 41, 42 and 43**.

Figure 8:
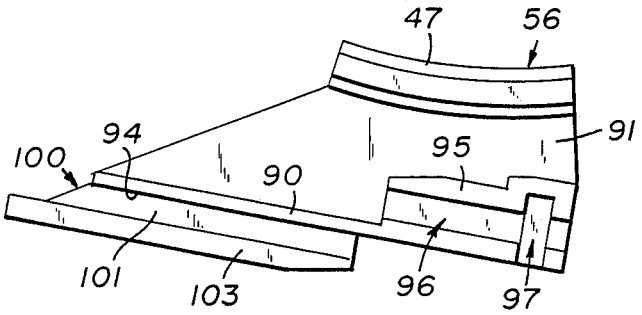
FIG. 8 is a side elevational view of an upper adjustment member having a glide structure for mounting on a track.

Referring further to FIGS. 2 and 3, a door-supporting structure in the form of an adjustment apparatus 46 is shown supporting doors 19 and 20 by means of glides 47 which slide on plastic bearing inserts 48 mounted on the transverse tracks 38–43. The glides 47 are preferably longitudinally arcuate to facilitate their sliding motion, as shown in FIG. 8. The inserts 48 are elongate and have sloping bearing surfaces 49, the bearing surfaces 49 of each pair of inserts 48 of adjacent tracks supporting a single glide 47, the bearing surfaces 49 sloping downwardly toward each other and toward the glide 47, and serving to maintain the glide in a central position. Each insert 48 is provided with a neck 50 having a hook 51 at the end thereof for engaging a detent 52 provided on the bottom of the transverse track flanges 38–43.

The adjustment apparatus 46, as shown in FIGS. 2, 3 and 4–10, is comprised of a lower or fixed adjustment apparatus member 55 and an upper or movable adjustment member 56. Referring to FIG. 2, the doors, for example door 20, are affixed to the lower adjustment apparatus members 55 by means of flanges 57 and 58 which are inserted into grooves 59 and 60 provided in the adjustment apparatus member 55. A longitudinal screw socket 61 is provided to receive and retain a screw for securing the doorframe members together. The doorframe 20 is provided with a gasket 62 which receives a glass panel 63.

Referring to FIGS. 4, 5, 6 and 7, a lower or fixed adjustment apparatus member 55 is shown and comprises a base 79 having grooves 59 and 60 on each side to receive flanges 57 and 58 of a doorframe 20 for attachment thereto. The base 79 has a clip 80 for engaging a detent provided in the door frame. The structure additionally has an inclined body portion 81 provided with inclined surfaces 82. A key slot 83 is provided comprised of a channel 84 having internal lateral recesses 85. A screw-supporting tab 86 is provided at the end of the structure. A screw aperture 87 is provided in the tab 86 for receiving a screw.

Figure 9:
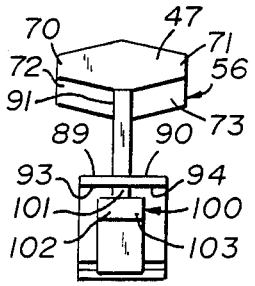
FIG. 9 is a rear view of the structure shown in FIG. 8.
Figure 10:
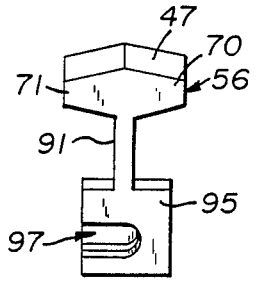
FIG. 10 is a front view of the movable adjustment member shown in FIG. 8.

Referring to FIGS. 8, 9 and 10, an upper or slidable adjustment apparatus member 56 is shown comprising a web 91, an arcuate glide member 47 extending therefrom, and flanges 89 and 90 defining inclined surfaces 93 and 94. The glide member 47 is provided with lateral flanges 70 and 71 having oblique bearing surfaces 72 and 73 which engage and are supported by the oblique surfaces 49 of the bearing inserts 48. Because of the oblique relationship of the bearing surfaces of the lateral flanges 70 and 71 and the bearing surfaces 49 of the bearing inserts 48, the glide members 47 are supported and maintained in a centrally located position, as shown particularly in FIG. 3, and are free to slide on the surfaces of the bearing inserts. The web 91 is also provided with body structure 95 having a screw-retaining channel 96 and a nut-retaining recess 97. Below the inclined surfaces 93 and 94 is an inverted T-shaped key 100 adapted to be slidably retained in the key slot 83, and comprising a web 101 having flanges 102 and 103.

Figure 11:
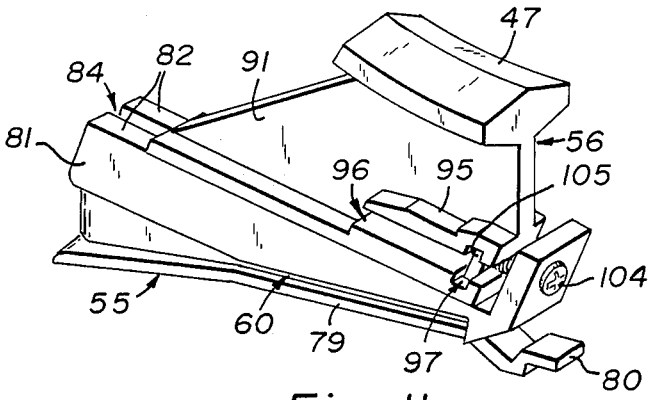
FIG. 11 is a perspective view of an adjustment apparatus according to the invention utilizing a glide mechanism adapted to be slidably supported on a track.
Figure 12:
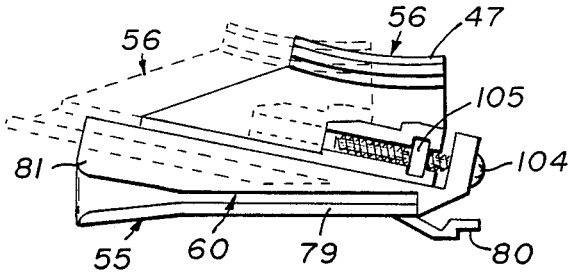
FIG. 12 is an elevational view of the adjustment apparatus of FIG. 11, the upper adjustment member being shown by solid lines in one position and broken lines in another.

The lower and upper adjustment apparatus members are shown in assembled form in FIGS. 11 and 12. A screw 104 engages a nut 105 for adjustment. The walls of the screw retaining channel 96 are made of such size that they grip the threads of the screw 104 and maintain the screw in position so that it does not spontaneously rotate.

In operation, a pair of adjustment apparatus structures of the glide type as shown in FIGS. 11 and 12 are mounted one at each end of an upper door frame. The screw 104 is then adjusted until the ends of the door are properly positioned to compensate for any out-of-plumb condition. The screw-receiving channels grip the threads of the screw and prevent it from rotating out of adjustment. The plastic bearing inserts 48 are mounted on the track flanges 38–43 and the glide members 47 or 92 are slidably supported by the bearing inserts 40, providing low friction movement of the glides. Moreover, the oblique bearing surfaces of the bearing inserts and the oblique bearing surfaces of the glide members.

The present invention provides an excellent means for movably supporting doors such as shower or bathtub enclosure doors. The combination of the low friction plastic bearing inserts 48 which support the low friction plastic glide contribute to door movement with very little friction. Additionally, because the bearing surfaces 49 of adjacent bearing inserts 48 are oblique with respect to each other and because the lateral flanges 70 and 71 of the glide members 47 are also provided with oblique bearing surfaces 72 and 73, the glide members 47 remain centrally located between adjacent tracks. Further, the structure permits the bearing inserts 48 to be mounted on the transverse track flanges and retained thereon by means of detents provided in the track flanges and hooks provided on the bearing inserts. This arrangement causes the bearing inserts to be retained on the track flanges very securely.

It is to be understood that the invention is not to be limited to the exact details of construction or operation or materials shown and described, as obvious modifications and equivalents will be apparent to one skilled in the art.

Invention is claimed as follows:

1. In combination:

A. a track to be fixedly mounted in a bathtub or shower enclosure, said track comprising:

(1) a supporting member adapted to be mounted on a wall or ceiling having a plurality of vertically oriented depending webs terminating in laterally extending track flanges, the track flanges of each pair of adjacent webs being spaced apart to define track spaces, and bearing inserts mounted on each of said track flanges, wherein said bearing inserts are integral structures comprised of a body portion mounted on the upper surface of each of said track flanges, and a neck portion extending therefrom and wrapped around the bottom of each track flange, said neck portion terminating in a hook engaging a detent provided at the bottom of said flange, and B. a door-supporting structure comprising:

(1) means at one end adapted to be affixed to the top edge of a door, (2) a web adapted to travel within said track spaces, and (3) a glide at the upper edge of said web having lateral flanges adapted to be slidably supported on said bearing inserts, wherein the lower surfaces of said glide are inclined upwardly and outwardly, and each pair of bearing inserts cooperating to define a track have upper surfaces declined inwardly toward each other, thereby maintaining said glide centrally positioned on said track.

2. A combination according to claim 1, wherein said glide is longitudinally arcuate, thereby facilitating its sliding movement on said bearing inserts.

3. A combination according to claim 1, wherein said glides and said bearing inserts are formed of a low friction plastic material.

4. A combination according to claim 1 wherein said door-supporting structure is additionally provided with means for raising and lowering a door attached thereto to compensate for out-of-plumb supporting structures.

5. In combination:

A. a laterally oriented supporting structure mounted between walls of a bath tub or shower enclosure, B. a track fixedly mounted on said supporting structure, said track comprising:

(1) a plurality of vertically oriented depending webs affixed at one end to said supporting structures and terminating in laterally extending track flanges, the track flanges of each pair of adjacent webs being spaced apart to define track spaces, and bearing inserts mounted on each of said track flanges, wherein said bearing inserts are integral structures comprised of a body portion mounted on the upper surface of each of said track flanges, and a neck portion extending therefrom and wrapped around the bottom of each track flange, said neck portion terminating in a hook engaging a detent provided at the bottom of said flange, C. a door, and D. a door-supporting structure comprising:

(1) means at one end affixed to the top edge of said door, (2) a web mounted to travel within said track spaces, and (3) a glide at the upper edge of said web having lateral flanges slidably supported on said bearing inserts, wherein the lower surfaces of said glide are inclined upwardly and outwardly, and each pair of bearing inserts cooperating to define a track have upper surfaces declined inwardly toward each other, thereby maintaining said glide centrally positioned on said track.

6. A combination according to claim 5, wherein said glide is longitudinally arcuate, thereby facilitating its sliding movement on said bearing inserts.

7. A combination according to claim 5, wherein said glides and said bearing inserts are formed of a low friction plastic material.

8. A combination according to claim 5, wherein said door-supporting structure is additionally provided with means for raising and lowering the door affixed thereto to compensate for out-of-plumb supporting structures.

* * * * *